US006190293B1

(12) United States Patent
Schuyler et al.

(10) Patent No.: US 6,190,293 B1
(45) Date of Patent: Feb. 20, 2001

(54) PUSH-UP EXERCISE APPARATUS

(76) Inventors: Richard Donald Schuyler, 6695 SW. 152nd Ave., Beaverton, OR (US) 97007; Richard Michael Aydelott, 2217 NE. 179th St. Unit 31, Ridgefield, WA (US) 98642

( * ) Notice: Under 35 U.S.C. 154(b), the term of this patent shall be extended for 0 days.

(21) Appl. No.: 09/569,014

(22) Filed: May 11, 2000

(51) Int. Cl.[7] ..... A63B 26/00
(52) U.S. Cl. ..... 482/141
(58) Field of Search ..... 482/141, 37, 148, 482/100, 136, 137, 19, 38, 42, 97, 98

(56) References Cited

U.S. PATENT DOCUMENTS

| | | | | |
|---|---|---|---|---|
| 3,746,335 | * | 7/1973 | Fichter et al. | 482/19 |
| 4,854,573 | | 8/1989 | Johannson et al. . | |
| 5,108,092 | * | 4/1992 | Hurst | 482/908 |
| 5,205,802 | | 4/1993 | Swisher . | |
| 5,226,868 | | 7/1993 | Montgomery . | |
| 5,336,148 | * | 8/1994 | Ish, III | 482/98 |
| 5,527,252 | | 6/1996 | Sather . | |
| 5,529,558 | * | 6/1996 | Koenig | 482/97 |
| 5,536,222 | * | 7/1996 | Banda et al. | 482/148 |

* cited by examiner

*Primary Examiner*—Stephen R. Crow
(74) *Attorney, Agent, or Firm*—Douglas G. Anderson

(57) ABSTRACT

An exercise apparatus is presented that allows for adjustments in height, and optionally width between hand grips, while maintaining an ergonomic grip that is substantially parallel to the user's body, regardless of the adjustment used.

12 Claims, 7 Drawing Sheets

FIG. 6
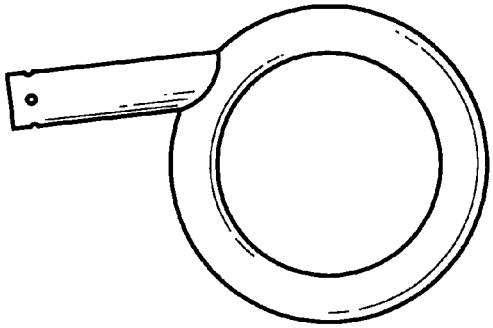
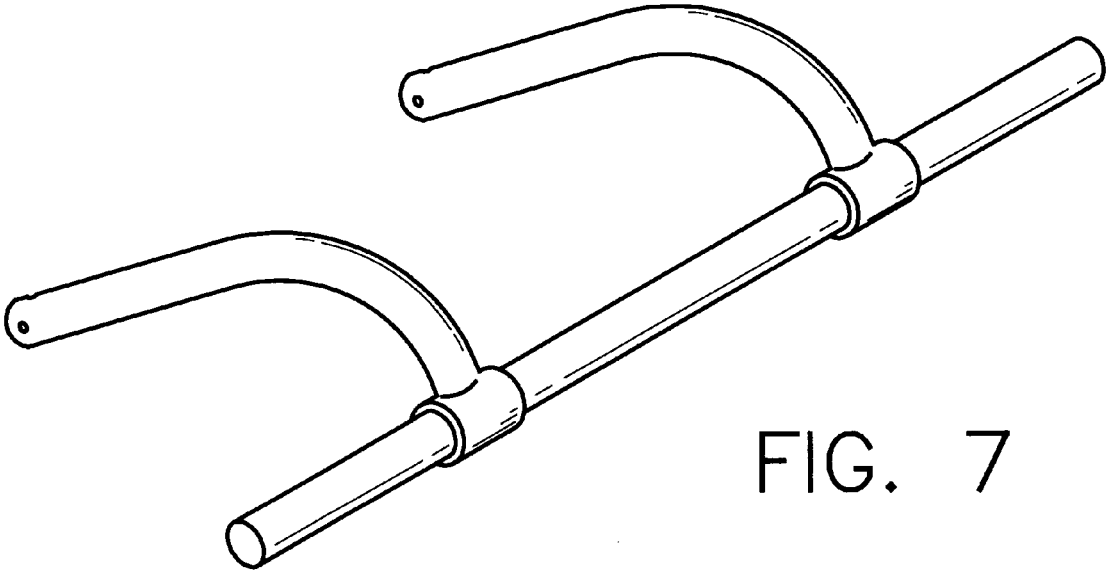
FIG. 7

PUSH-UP EXERCISE APPARATUS

FIELD OF THE INVENTION

This invention relates to an exercise apparatus used for performing different types of push-up exercises, allowing the user to optimize positioning for individual use.

BACKGROUND OF THE INVENTION

Exercise devices that raise and incline the user are well known in the art. U.S. Pat. No. 5,527,252, for example, demonstrates an apparatus that can be placed on a riser or a staircase, thereby raising and inclining the user. The user can only adjust the incline, however, by raising the apparatus to the next riser of the staircase, thereby limiting the amount of adjustment. Unfortunately, the apparatus also requires the user to have access to a staircase that won't be used during the exercise routine. Another disadvantage of this apparatus, however, is the inability to easily adjust the width of the grips to allow for different sized users, or to allow target training of specific parts of the muscles exercised.

Similarly, U.S. Pat. No. 4,854,573 reveals a set of three handles ran between a pair of triangular endplates, wherein each handle is placed a different distance from the edge of the endplates. The user can then grip one of the three handles and thereby adjust the incline off the floor, depending on which of the handles used. The variation between the lowest lift and highest lift is thereby dependent on the size of the endplates, and the placement of the handles within the endplates. Unfortunately, in order to have the opportunity for a large inclination, the endplates must be very large, thus making storage a practical issue. Furthermore, the handles are placed parallel to the floor or other resting surface, such that as the inclination angle gets large, undue stress is placed on the wrists and hands due to the handles being at oblique angles to the wrists.

The apparatus described in U.S Pat. No. 5,226,868 provides the user the option adjusting the width of the grips by placing the grips in any of a series of receiver holes. This design, however, does not provide a means of elevating the user to decrease resistance, and it maintains the handles parallel to the floor, thereby putting the wrists of the user in unhealthy angles.

Finally, the apparatus described in U.S. Pat. No. 5,205,802 provides a pair of handles that are able to rotate in a circle around an axis perpendicular to the floor in an attempt to ease the tension provided on the hands, wrists, and arms. It also provides the user the ability to change the width between the two handles to allow for various sized users, as well as spot training desired muscles.

There still remains, however, a need for an apparatus that can provide a tool easily adjustable for advancing degrees of difficulty while maintaining proper hand placement to prevent undo hand, wrist, and arm strain.

SUMMARY OF THE INVENTION

The present invention provides and apparatus which provides an improved method for doing push-ups. The apparatus provides adjustment means for a variety of users, while providing the user with an ergonomic handle that keeps the hands and wrists in the most comfortable and stable position for each specific user.

In accordance with the present invention, the apparatus contains a "U" shaped support base, from which a support riser mounts at the bottom of the support base. The support riser contains an adjustment mechanism consisting of a pair of adjustment plates that have notches cut into them that will support and securely hold a pin or rod. A grip interface, which is essentially a metal rod, is rotatably connected at the bottom of the support riser, and contains a pin on the shaft of the rod that interacts with the adjustment plates. By placing the pin of the grip interface in the desired notches of the adjustment plates, the user can select the inclination and elevation desired for the exercise to be performed. The interface plate notches are cut to allow the apparatus to be adjusted from a position approximately parallel to the floor to incrementally to approximately perpendicular to the floor. The grip interface then extends from the support riser over the support base, and contains ergonomic grips that provide a gripping surface approximately parallel to the body of the user, regardless of the inclination angle of the adjustment mechanism.

Optionally, the distance between the grips can also be adjusted to accommodate different sized users, and to spot-train specific areas of desired muscles. If such an enhanced feature is used, The grip interface contains a channel that rigidly connects to one grip, and provides a pivot pin holding an end of the other grip, with a set of holes drilled into the channel in a line approximately parallel to the front edge of the channel to allow the second grip to be rigidly pinned into the channel at the desired width.

BRIEF DESCRIPTION OF THE DRAWINGS

For the purpose of illustrating the invention, there is shown in the accompanying drawings one preferred embodiments of the present invention. It is to be understood that the invention is not intended to be limited to the precise arrangements and instrumentalities shown, but rather by the appended claims.

FIG. 6 is a side view of an alternative grip embodiment of the present invention.

FIG. 7 is a perspective view of an alternative grip embodiment of the present invention.

DETAILED DESCRIPTION OF THE INVENTION

Figure 1:
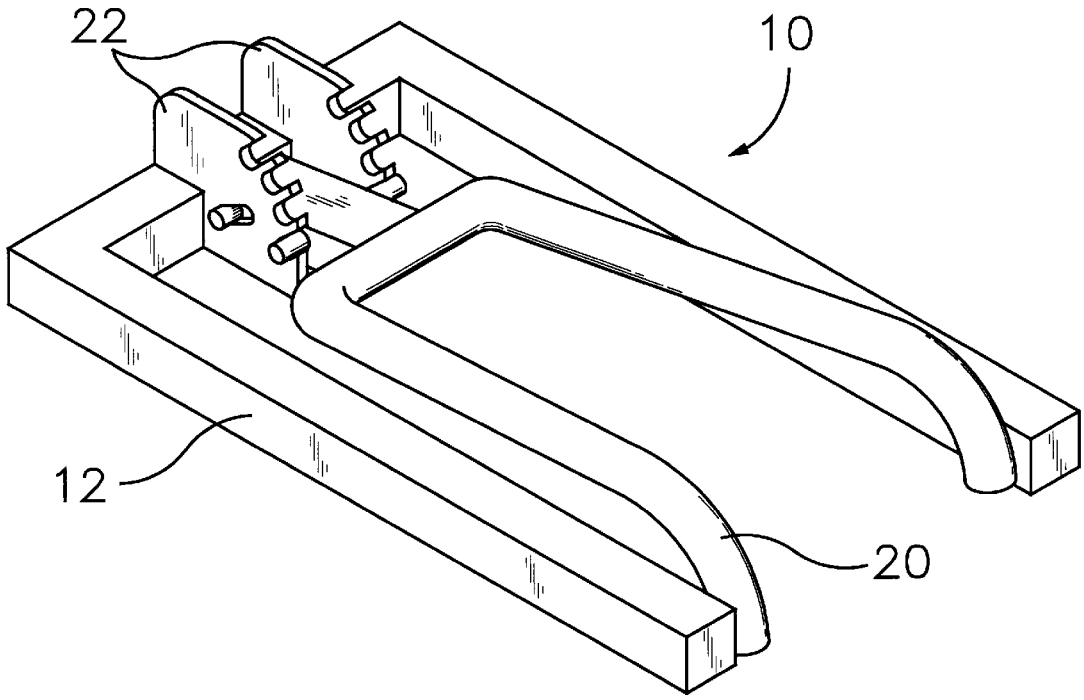
FIG. 1 is a perspective view of a preferred embodiment of the present invention, with the grips lowered to the lowest position.

Turning now to FIG. 1, a push-up exercise apparatus 10 includes a support base 12 that provides stability to the apparatus. The support base 12 generally extends the same direction as the remainder of the apparatus, thus providing a high degree of stability both during storage and during operation. The support base 12 has a general "u" shape with two long stabilizers connected by a crossbeam. Attached to the crossbeam is a pair of adjustment plates 22, which is in turn moveably attached to one or more grips 20.

Figure 2A:
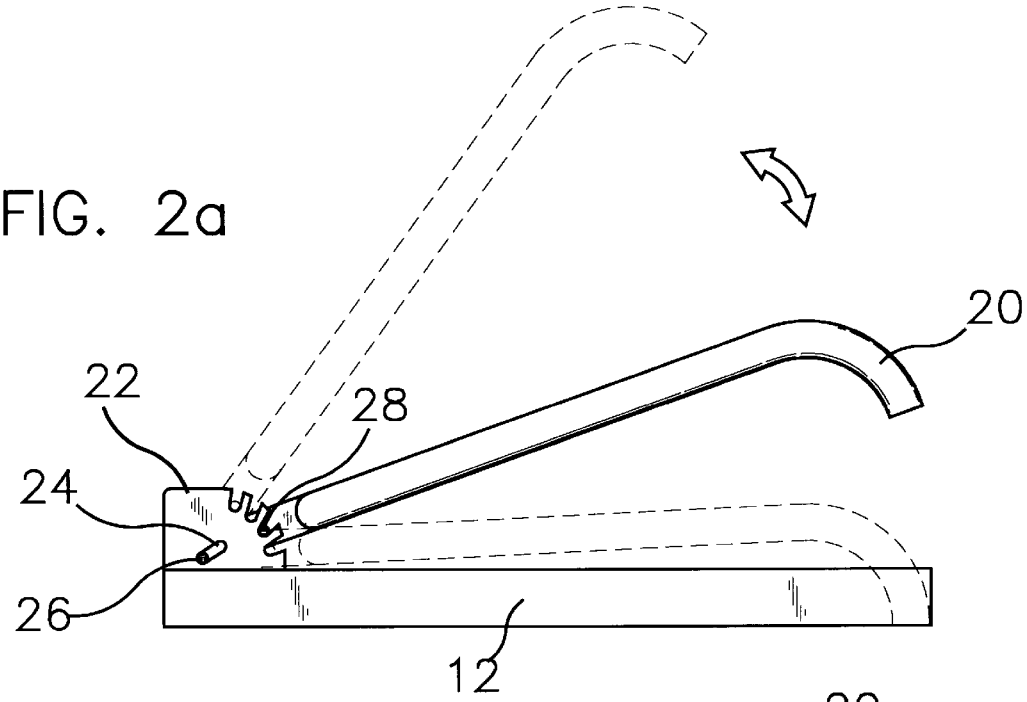
FIG. 2*a* is a side view of FIG. 1, demonstrating adjustment of the grips.
Figure 2B:
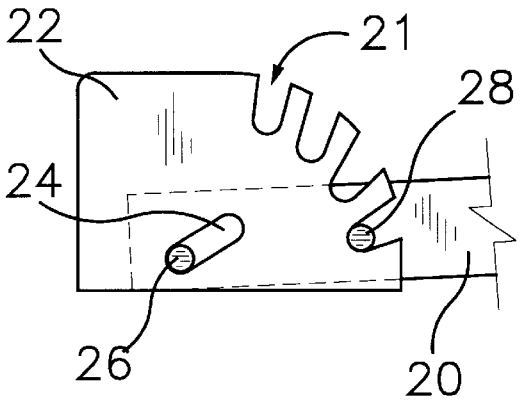
FIG. 2*b* is a side view of a preferred embodiment of the present invention, wherein the adjustment plate is in the secured position.
Figure 2C:
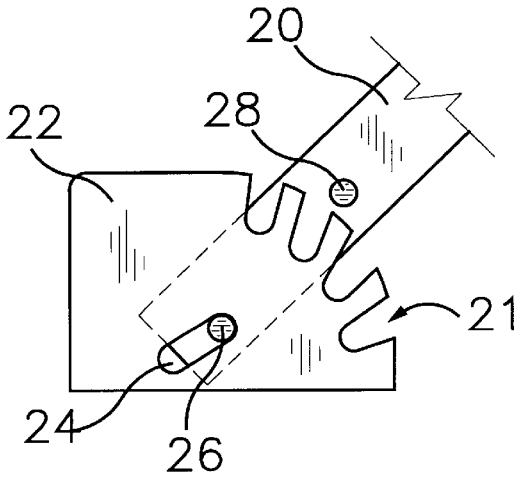
FIG. 2*c* is a side view of a preferred embodiment of the present invention, wherein the adjustment plate is being adjusted.

As depicted in FIGS. 2*a,* 2*b,* and 2*c,* the grips 20 are locked into place by securely placing a height adjustment locking pin 28 into the desired one of several adjustment notches. The grips 20 are securely locked into a desired height, as shown in FIG. 2*b,* when the height adjustment locking pin 28 is pushed into the bottom of the desired adjustment notch 21. The slide pin 26 seats at the bottom of slide groove 24 keeps the grips 20 from inadvertently slipping out due to the angle of the slide groove 24. In order to adjust the height of the grips 20, the user simply pulls on the grips 20 in a direction co-linear with the grips 20. When pulled, the slide pin 26 slides to the top of the slide groove 24, and allows the height adjustment locking pin 28 to be extended past the edges of the adjustment notches 21. The slide pin 26 now becomes a pivot point for rotating the grips 20 to the desired height. The user then pushes the grips 20 in a co-linear direction with the grips 20, until the height adjustment locking pin 28 seats in the bottom of the desired adjustment notch 21, and the slide pin 26 seats at the bottom of the slide groove 24. Alignment notches 21 are arranged such that the grips 20 can be angularly adjusted incrementally from horizontal to vertical, thus giving a wide range of height adjustment. Alternately, a series of holes (not shown) cut into the adjustment plates could be used, with a simple bolt or rod placed through the holes to secure the adjustment.

Figure 3:
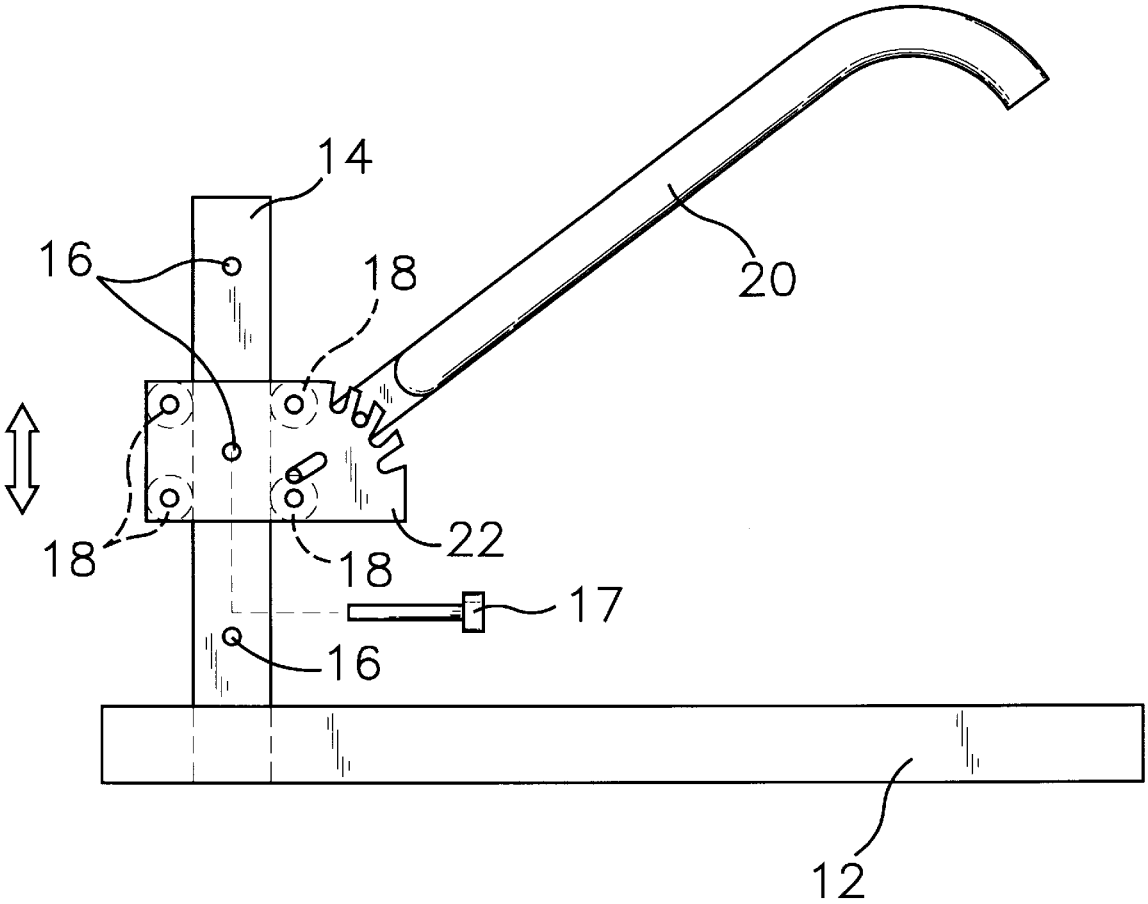
FIG. 3 is a side view of an alternate embodiment of the present invention, incorporating a secondary means of raising the grips.

FIG. 3 demonstrates an additional height adjustment incorporating the adjustment of FIGS. 2*a,* 2*b,* and 2*c* with a vertical riser 14, which is rigidly attached to the support base 12. The vertical riser 14 has a plurality of vertical adjustment holes 16 milled into the riser 14, wherein the adjustment plates 22 can be vertically raised to the desired height, and then securely held by inserting a height adjustment pin 17 into the desired vertical adjustment hole 16. The adjustment plates 22 can optionally have a plurality of wheels 18 mounted on the adjustment plates 22 such that they interface with the vertical riser 14, and smoothly glide upon the surface of the vertical riser 14 when being adjusted. The wheels 18 can also act as a shock absorber for the grips 20 when a moment is applied about the height adjustment pin 17.

Figure 4:
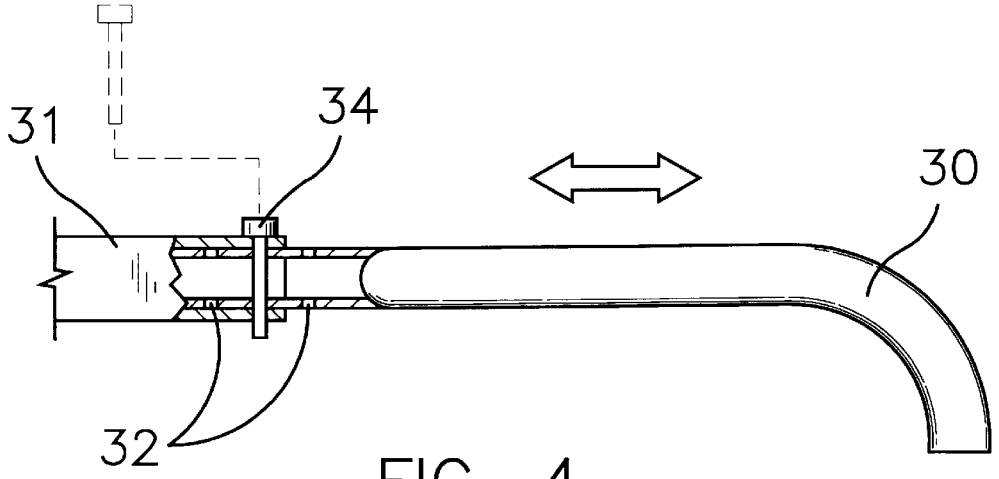
FIG. 4 is a side view of the grip interface and the grip of a preferred embodiment of the present invention.

Turning now to FIG. 4, a grip interface 31 is demonstrated, wherein the grip interface 31 at one end attaches to the adjustment plates (not shown) and at the other end has a plurality of grip extension locking holes 32 milled into the grip interface 31. The grip interface 31 is hollow on an end, and allows for the insertion of a grip handle 30. The grip handle 30 has a set of holes (not shown) milled in desired locations such that the holes can be aligned with the grip extension locking holes 32. The grip handle 30 is inserted into the grip interface 31 to the desired length and orientation, and then locked into place by placing a grip extension locking pin 34 into the grip extension locking holes 32.

Figure 5A:
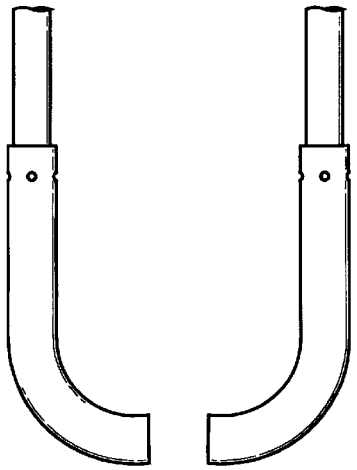
FIG. 5*a* is a top view of the grips of a preferred embodiment of the present invention, wherein the curved handles of the grips face toward each other.
Figure 5B:
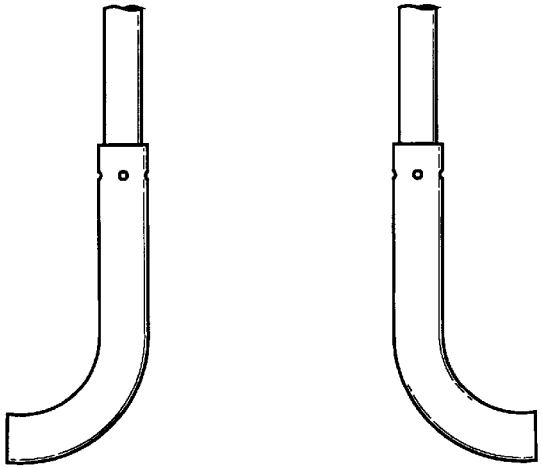
FIG. 5*b* is a top view of the grips of a preferred embodiment of the present invention, wherein the curved handles of the grips face away from each other.

As shown in FIGS. 5*a* and 5*b,* the grip handles are curved at the end opposite the end that mates with the grip interface 31, thereby providing an ergonomic surface that provides proper angles for the user to hold the grips 30. The grips 30 may or may not have a padded surface for comfort of the user, as desired. The grips 30 can be attached to the grip interface 31 such that the curved ends face each other (as shown in FIG. 5*a*), face away from each other (as shown in FIG. 5*b*), face down, or any combination thereof. Alternative grips can have many different shapes, as demonstrated in FIGS. 6 and 7, without changing the scope or intention of the present invention.

Figure 8A:
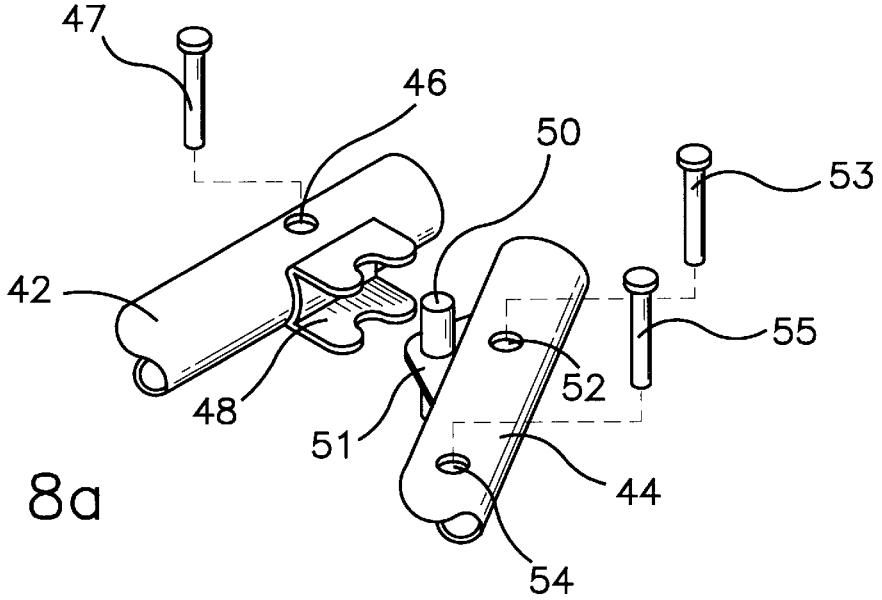
FIG. 8*a* is a perspective view of a grip interface assembly of a preferred embodiment of the present invention.
Figure 8B:
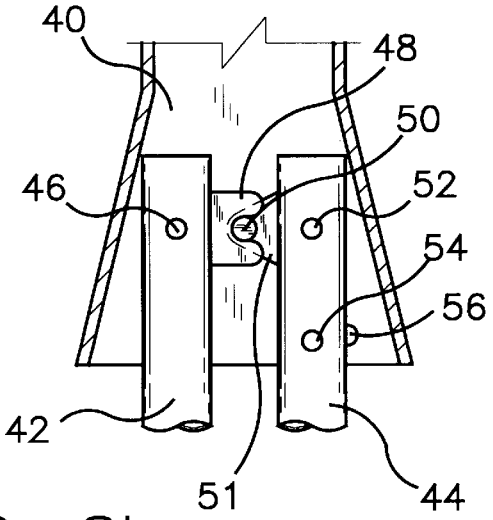
FIG. 8*b* is a top view of a grip interface assembly of a preferred embodiment of the present invention, wherein the grips are adjusted in close proximity to each other.
Figure 8C:
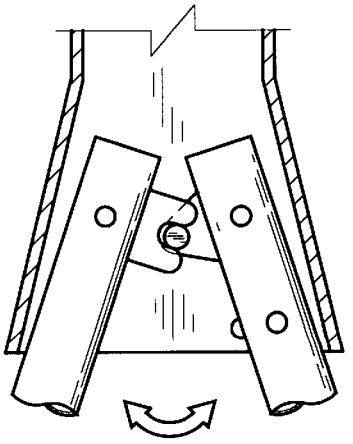
FIG. 8*c* is a top view of a grip interface assembly of a preferred embodiment of the present invention, wherein the grips are adjusted away from each other.

FIGS. 8*a,* 8*b,* and 8*c* demonstrate a method of adjusting the width between the grips (not shown) such that the user can spot train specific areas of the muscles used. As such, a width adjustment channel 40 is attached at one end to the adjustment plates (not shown). Within the width adjustment channel 40 are two grip interfaces 42 and 44. Grip interface 44 is pinned to the width adjustment channel 40 through a grip securing hole 52, using a grip securing pin 53. Grip interface 44 can be pivoted about grip securing pin 53 to move the grip interface 44 laterally closer to, or away from, grip interface 42. When the user obtains the desired distance between grip interfaces 42 and 44, grip interface 44 is rigidly pinned into place by inserting a grip width adjustment pin 55 through grip adjustment hole 54 and channel adjustment hole 56. Alternately, a channel adjustment slot (not shown) could be used in conjunction with a clamp mechanism, such as a wing nut assembly, to offer infinite width adjustment. Grip interface 44 has a grip pivot plate 51 mounted on one side, which contains a grip pivot shaft 50. Grip interface 42 is pinned to the width adjustment channel 40 through the grip securing hole 46 by placing a grip securing pin 47 therein. Grip interface 42 also has a grip pivot interface 48 that interacts with the grip pivot shaft 50, thereby giving a second pin point to hold grip interface 42 securely in place. The proximal placement of the grip pivot shaft 50 in relation to grip securing pin 47 provides a lateral movement of grip interface 42 in the opposite-direction of the movement of grip interface 44, thereby increasing the relative distance between grips (not shown) with each movement.

Figure 9:
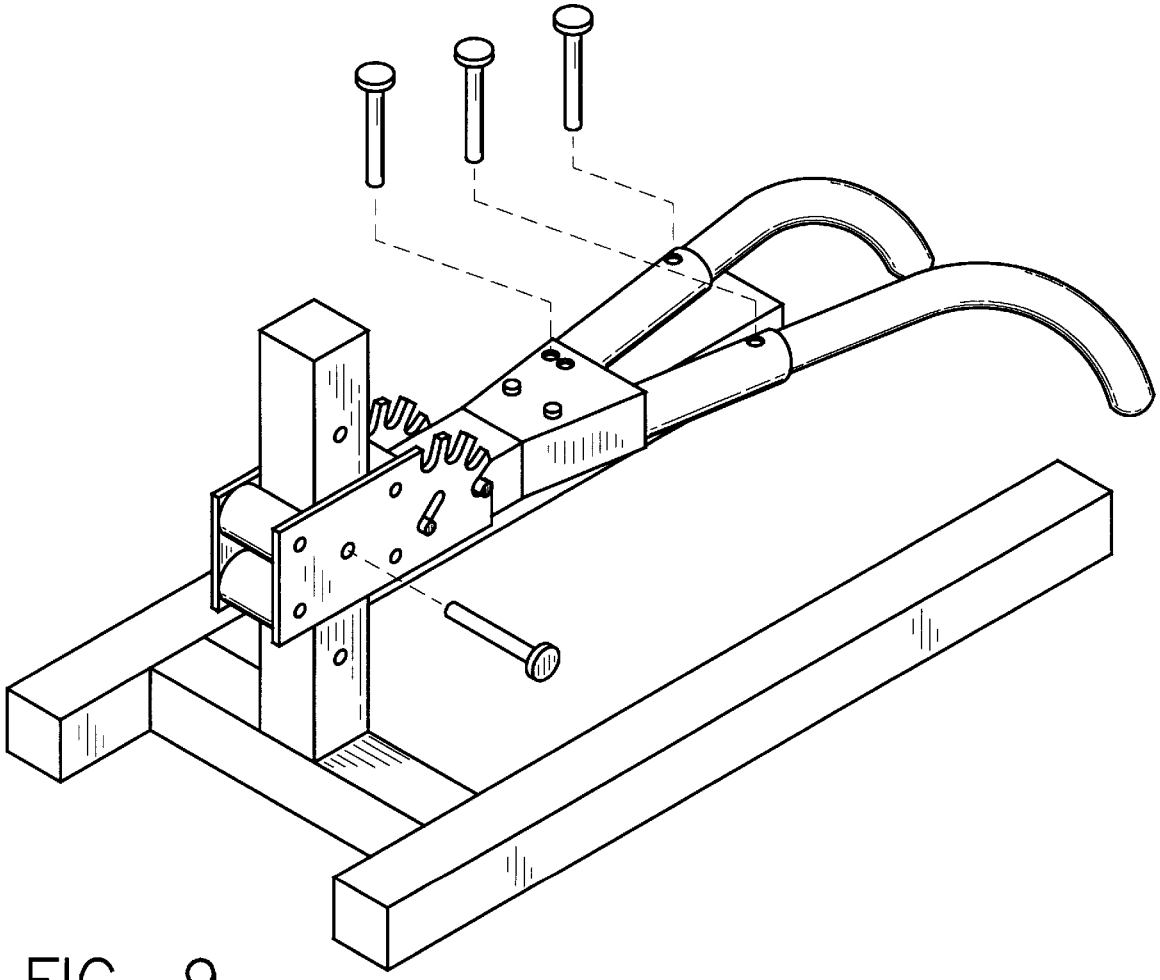
FIG. 9 is a perspective view of a preferred embodiment of the present invention.

FIG. 9 then displays a perspective view of the present invention, wherein the push-up exercise apparatus can be adjusted to allow the user to select the optimal width between grips, and the optimal height to provide incline desired by the user, while providing an ergonomically desirous grip at any adjustment.

Other embodiments of the present invention will be apparent to those skilled in the art from a consideration of this specification or practice of the invention disclosed herein. It is intended that the specification be considered in all aspects only as illustrative and not restrictive. The scope of the invention is, therefore, indicated by the appended claims rather than by the foregoing description. All changes which come within the meaning and range of the equivalence of the claims are to be embraced within their scope.

What is claimed is:

1. An adjustable push-up exercise apparatus for use in performing various push-up maneuvers, comprising:

a base;

one or more adjustment plates rigidly connected to said base, each said adjustment plate, having a plurality of adjustment notches cut along the periphery of said adjustment plate, and each said adjustment plate having a slide groove;

a grip interface moveably attached to each said adjustment plate, said grip interface having a pivot pin at one end of said grip interface, said pin being placed in the slide groove of each said adjustment plate, and a second pin on a shaft of said grip interface that interacts with, and is seated in, said adjustment notches of each said adjustment plate; and at least one grip that attaches to said grip interface opposite the end of said grip interface containing said pivot pin.

2. An exercise apparatus according to claim 1, wherein said grip interface can interact with said adjustment notches such that said grip interface can be incrementally adjusted from approximately horizontal to approximately vertical.

3. An exercise apparatus according to claim 1, wherein said two said grips are connected to said grip interface, said grips having a curved handle for user interface thereby providing a grip surface approximately parallel to the user's body.

4. An exercise apparatus according to claim 1, wherein said grip is coated with a pliable polymer at the user interface.

5. An adjustable push-up exercise apparatus for use in performing various push-up maneuvers, comprising:

a base;

one or more adjustment plates rigidly connected to said base, each said adjustment plate each having a plurality of adjustment notches cut along the periphery of each said adjustment plate, and each said adjustment plate having a slide groove;

a grip interface moveably attached to each said adjustment plate, said grip interface having a pivot pin at one end of said grip interface, said pin being placed in the slide groove of each said adjustment plate, and a second pin on a shaft of said grip interface that interacts with, and is seated in, said adjustment notches of each said adjustment plate; and a width adjustment channel that attaches to said grip interface opposite the end of said grip interface containing said pivot pin, wherein said width adjustment channel contains a plurality of grips pivotally mounted in said width adjustment channel, and a plurality of securing voids wherein one of said grips can be adjustably secured, thereby providing adjustment of the distance between said grips.

6. An exercise apparatus according to claim 5, wherein said grip interface can interact with said adjustment notches such that said grip interface can be incrementally adjusted from approximately horizontal to approximately vertical.

7. An exercise apparatus according to claim 5, wherein said two said grips are connected to said grip interface, said grips having a curved handle for user interface thereby providing a grip surface approximately parallel to the user's body.

8. An exercise apparatus according to claim 5, wherein said grip is coated with a pliable polymer at the user interface.

9. An adjustable push-up exercise apparatus for use in performing various push-up maneuvers, comprising:

a base;

one or more adjustment plates rigidly connected to said base, each said adjustment plate having a plurality of adjustment receiving holes cut along the periphery of each said adjustment plate, and each said adjustment plate having a pivot hole;

a grip interface moveably attached to each said adjustment plate, said grip interface having a pivot pin at one end of said grip interface, said pin being placed in the slide groove of each said adjustment plate, and a second pin on a shaft of said grip interface that interacts with, and is seated in, said adjustment holes of each said adjustment plate; and at least one grip that attaches to said grip interface opposite end of said grip interface containing said pivot pin.

10. An exercise apparatus according to claim 9, wherein said grip interface can interact with said adjustment holes such that said grip interface can be incrementally adjusted from approximately horizontal to approximately vertical.

11. An exercise apparatus according to claim 9, wherein said two said grips are connected to said grip interface, said grips having a curved handle for user interface thereby providing a grip surface approximately parallel to the user's body.

12. An exercise apparatus according to claim 9, wherein said grip is coated with a pliable polymer at the user interface.

* * * * *